United States Patent [19]

Sims

[11] 4,275,370

[45] Jun. 23, 1981

[54] ELECTRICAL OVERLOAD CIRCUIT BREAKER

[75] Inventor: Raymond B. Sims, Beaconsfield, England

[73] Assignee: Delta Materials Research Limited, London, England

[21] Appl. No.: 58,740

[22] Filed: Jul. 18, 1979

[30] Foreign Application Priority Data

Jul. 21, 1978 [GB] United Kingdom ..... 30681/78
Sep. 14, 1978 [GB] United Kingdom ..... 36850/78

[51] Int. Cl.[3] ..... H01H 75/12; H01H 77/04

[52] U.S. Cl. ..... 335/37; 335/141; 337/140

[58] Field of Search ..... 335/37, 141, 143, 171; 337/140

[56] References Cited

U.S. PATENT DOCUMENTS

| | | | |
|---|---|---|---|
| 2,443,090 | 6/1948 | Wise | 335/143 |
| 2,842,635 | 7/1958 | Cole | 335/37 |
| 3,731,247 | 5/1973 | Levinn | 337/140 |

*Primary Examiner*—Harold Broome
*Attorney, Agent, or Firm*—Lee & Smith

[57] ABSTRACT

An electrical overload circuit breaker utilizes as the current-responsive tripping mechanism a solenoid, the coil of which is constituted by a helical spring of shape memory effect material and which mechanically acts on the armature. There is a non-SME spring which also acts on the armature but in a direction opposing the SME spring. The current is passed through the SME spring and, when it becomes excessive, the armature is urged both mechanically and electromagnetically in a tripping direction.

12 Claims, 2 Drawing Figures

ELECTRICAL OVERLOAD CIRCUIT BREAKER

Figure 1:
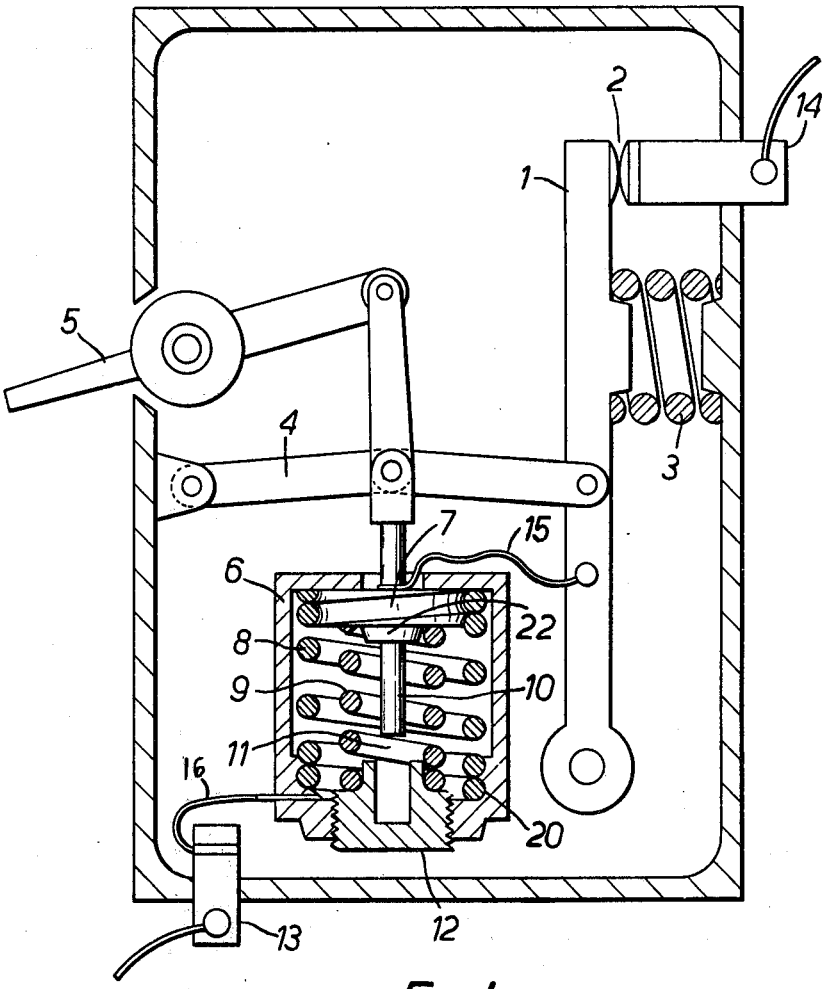

This invention relates to electrical overload circuit breakers. Such circuit breakers are increasingly employed in place of fuses to protect circuits from overloads, and are required to open the protected circuit on the occurrence of a prolonged overload of relatively small magnitude, e.g. 50% above nominal current, and instantly on the occurrence of a high overload, e.g. 4–9 times the nominal current.

Known overload circuit breakers employ, firstly, a bimetal strip and, secondly, a solenoid, both in series with the contacts of the circuit breaker and both arranged to cause opening of the contacts when prescribed movements of the bimetal strip and solenoid armature occur. A circuit breaker should occupy as little space as possible and must contain within its enclosure means for quenching the arc formed when the contacts open. However, the tripping mechanism—the bimetal strip and the solenoid—occupy a substantial proportion of the enclosure and the volume available for arc quenching limits the overload current the circuit breaker can handle.

In accordance with the present invention, the bimetal strip is dispensed with and the solenoid coil is or includes a helical spring of shape memory effect material operatively acting on the armature mechanically and adapted to urge the armature in tripping direction on being heated by current passing through the spring. The SME spring then acts both electromagnetically and mechanically on the armature and performs the functions of both the bimetal strip and the solenoid of previously known circuit breakers. The space within the enclosure of the circuit breaker required for the tripping mechanism is reduced, leaving more space available for arc quenching.

By a "shape memory effect material" or a "SME material" is meant a material having an elastic modulus which varies significantly with temperature in a reversible manner, over a transition temperature range. Such materials are well known and may comprise a suitable titanium-nickel alloy, or a Cu-Zn-X alloy where X can be aluminium, tin or silicon, or a Cu-Al-Y alloy where Y is iron, manganese or nickel. The preferred material is a copper-zinc-aluminum alloy. An SME material is capable of effecting a substantial displacement and to exert a considerable effort when subjected to temperature change within the transition temperature range.

It is preferred to utilise the SME spring in tension and to have the spring conditioned to contract axially on rise of temperature within the transition temperature range. Then, the electromagnetic attraction between the coils of the spring acts to augment the forces on the armature due to the solenoid effect and the SME effect.

Advantageously, the armature is biased by a second spring which does not exhibit shape memory effect properties and which opposes the SME spring. The combination of the SME spring and the second or bias spring has a displacement/temperature characteristic exhibiting smaller hysteresis that when the SME spring is employed alone. Further, the bias applied by the second spring may be adjustable to vary the temperature at which the tripping mechanism operates.

The overload circuit breaker may further comprise a pair of electrical contacts which are relatively movable between closed and open positions; resilient means connected to bias the contacts to the open position; and retaining means for retaining the contacts in the closed position against the action of the resilient means, but actuable by the tripping mechanism to release the contacts. By that arrangement, it is possible to have the resilient means acting permanently in a direction to open the contacts, unlike previously known arrangements where a spring has acted, firstly, to retain the contacts in the closed position and, secondly, when tripping occurs, to urge the contacts apart. A more positive and faster action is achieved by this aspect of the invention.

Figure 2:
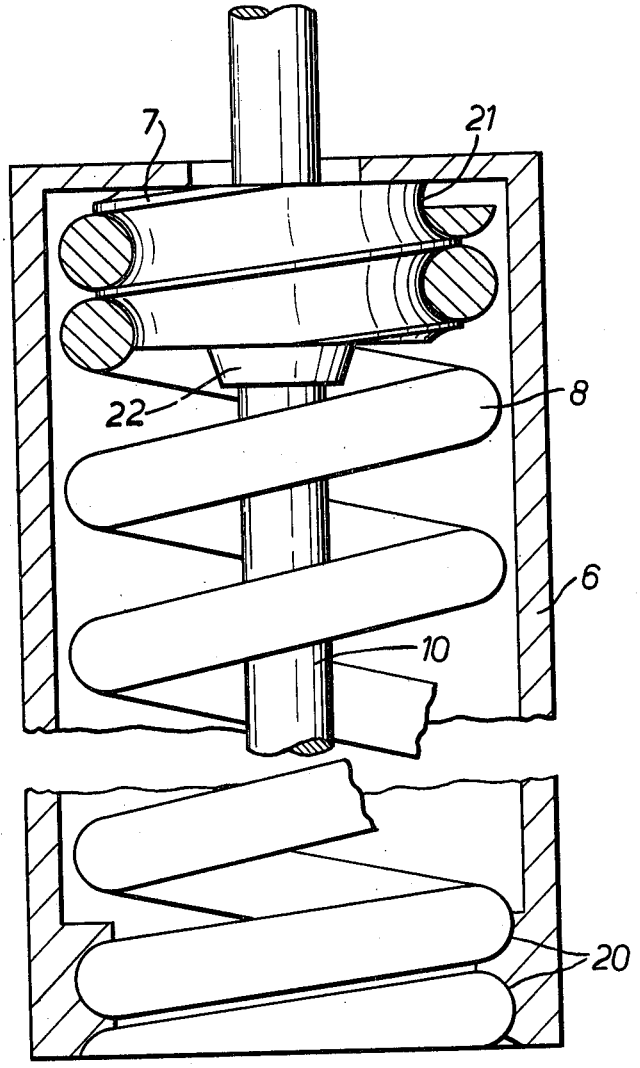

The invention will be more readily understood by way of example from the following description of an electrical overload circuit breaker in accordance therewith, reference being made to the accompanying drawings, in which FIG. 1 diagrammatically illustrates the overload circuit breaker, and FIG. 2 shows on enlarged scale the shape memory effect (SME) spring and its mountings.

FIG. 1 illustrates the contacts of the circuit breaker and the tripping mechanism for opening those contacts when an overload occurs. The remainder of the circuit breaker—the casing and the arc quenching equipment—are not illustrated as being of conventional form.

A pivoted main contact arm 1 carries one of a pair of electrical contacts 2 and is continually acted on by resilient means, in the form of a main compression spring 3 which urges the arm 1 in a direction to open the contacts 2. The contact arm 1 is also connected to retaining means, in the form of a toggle mechanism 4 which, when in the position shown, retains the contacts 2 in the closed position. A dolly 5 is pivotally connected to the toggle mechanism 4 in order to bring the toggle mechanism into the normal position as shown in FIG. 1.

Below the toggle mechanism 4 is an overload tripping mechanism consisting of a magnetically permeable soft steel cage 6 acting as a magnetic loop. A central opening in the top of the cage is normally closed by an armature, which is formed by a soft steel spindle 10 and a soft steel plug 7. The armature is carried by the toggle mechanism 4 by means of the upper part of spindle 10 which passes through the central opening and which is fixed to the plug 7. The armature 7 10 is acted on oppositely by, firstly, a helical tension spring 8 of SME material, and an inner compression spring 9 of ordinary spring steel. The action of the SME coil spring 8 is thus biased by the non-SME spring 9.

The lower part of the soft steel spindle 10 extends within the inner spring 9 and forms plug an extension of the soft steel armature 7. An airgap 11 is formed between the bottom of the spindle 10 and a steel calibrating screw 12 threaded into the base of the cage 6. The biasing spring 9 engages at its lower end against the screw 12 so that is compression can be adjusted.

The lower end of SME spring 8 is held captive in the bottom of cage 6 by having the interior of the cage threaded at 20 at the lower end to receive the lowermost coils of the spring (see particularly FIG. 2). The upper end of the SME spring is similarly secured to plug 7 by having the latter threaded externally at 21 to capture the uppermost coils of spring 8 (see FIG. 2). Compression spring 9 of non-SME material engages the lower side of plug 7 about a central boss 22 and biases SME spring 8 in tension.

The circuit to be protected is connected in series with terminals 13 and 14, which are connected together through the contacts 2 when closed, the contact arm 1, a lead 15, the spring 8, and a further lead 16; the load current thus passes through the SME spring 8 which acts as a solenoid in conjunction with the armature 7, 10.

The spring 8 is preferably made of a copper-zinc-aluminium alloy having a composition of 70.1% copper, 25.9% zinc and 4.0% aluminium, and heat treated to bring it to memory condition. It has a transition temperature mid-point of about 40°Cm so that as the temperature of the spring 8 rises above ambient temperature, the elastic modulus progressively increases. The spring has been stressed in tension at a temperature below the transition tension range.

During normal current conditions, when the toggle mechanism is in the position shown, it is restrained by the engagement of armature plug 7 with the cage 6 and by the action of the main spring 3. In that condition, contacts 2 are closed. When an overload between 1.5 and 4 times the nominal current occurs, the temperature of SME spring 8 increases progressively through the transition temperature range of the SME material and the resulting increase in the stiffness of the spring causes it to contract axially against the bias applied by the non-SME spring 9. When the downward movement of the armature 7, 10 has been continued sufficiently, the toggle mechanism 4 is pulled downwardly over dead-centre; when that occurs, the main spring 3 forces the contacts 2 apart with its full power so that the opening time of the contacts is kept to a minimum. With currents in the state range, the solenoid effect is not sufficient to trip the toggle mechanism 4 and tripping is effected by a prolonged overload of sufficient duration to result in rise in temperature of the SME spring 8 through the transition temperature range.

When a massive overload of 4 to 9 times a nominal current occurs, the high current in the helical spring 8 generates a magnetic field through the cage, resulting in large magnetic forces in gap 11 and causing the armature 7, 10 to be pulled rapidly downwards, again to break the toggle mechanism 4 and open contacts 2 almost instantaneously. The contraction of the spring 8 due to the shape memory effect is slower acting and takes little part in the tripping action.

At all levels, the current through the spring 8 creates a magnetic attraction between the turns of the spring tending to contract the spring axially and to urge the armature in tripping direction. The attraction between the turns of the spring augments the solenoid and SME forces acting on the armature.

The contact breaker can be restored to the normal condition following an overload, by manual operation of dolly 5 to raise the toggle mechanism 4 again over-centre.

As will be seen, the circuit breaker is extremely simple, both to manufacture and to assemble, consisting only of a limited number of parts, and the circuit breaker can thus be manufactured relatively cheaply. The fact that the main spring 3 acts directly on the contacts 2 through the arm 1 results in the opening time of the contacts being very short and allows the contact breaker to handle a high overload current. Further, the volume occupied by the tripping mechanism illustrated is relatively small, thereby providing a relatively large volume in the enclosure of the circuit breaker to be utilised for a large arc quenching chamber, again to enable the circuit breaker to handle high overload currents without failure. Finally, since the circuit through the circuit breaker, i.e. between the terminals 13 and 14, is short and through relatively low resistivity materials, it can handle currents up to a high value, e.g. 5 to 80 amps nominal rating without overheating.

What I claim is:

1. An electrical overload circuit breaker comprising:

(a) a pair of contacts which are relatively movable between open and closed positions;

(b) a helical spring made predominantly of a shape memory effect material having an elastic modulus which varies significantly with temperature in a reversible manner over a transition temperature range;

(c) an armature operatively acted on mechanically by said helical spring;

(d) said helical spring and said armature forming a solenoid in which said armature is electromagnetically urged on passage of current through said spring in the same direction as said armature is urged by said spring on rise of temperature thereof;

(e) coupling means between said armature and said contacts whereby said contacts are opened on specified movement of said armature in said direction; and (f) connection means for passing a current in series through said contacts when closed and said helical spring.

2. An electrical overload circuit breaker as claimed in claim 1, wherein said helical SME spring is a tension spring, and said helical SME spring is conditioned to contract axially in said direction on rise of temperature through said transition temperature range.

3. An electrical overload circuit breaker as claimed in claim 1, further comprising a second spring which does not exhibit significant shape memory effect and which biases said armature oppositely to said helical SME spring.

4. An electrical overload circuit breaker as claimed in claim 1, wherein said helical SME spring is a tension spring conditioned to contract axially in said direction on rise of temperature through said transition temperature range, and further comprising a helical compression spring which does not exhibit significant shape memory effect and which acts operatively on said armature in opposition to said SME spring.

5. An electrical overload circuit breaker as claimed in claim 4, wherein the compressive stress applied by said compression spring is adjustable.

6. An electrical overload circuit breaker as claimed in claim 1, wherein said coupling means includes a toggle mechanism.

7. An electrical overload circuit breaker as claimed in claim 1, further comprising resilient means acting on said contacts and biasing said contacts to the open position; and wherein said coupling means includes retaining means normally retaining said contacts in closed position, but actuatable by said armature to release said contacts for movement to said open position.

8. An electrical overload circuit breaker comprising:

(a) a fixed contact;

(b) a movable contact mounted for movement between a closed position engaging said fixed contact and an open position;

(c) resilient means operatively acting on said movable contact in a direction towards said open position;

(d) retaining means also operatively acting on said movable contact and normally retaining said movable contact in said closed position, but actuatable to release said movable contact for movement to the open position under the action of said resilient means;

(e) an armature coupled to said retaining means and movable in a direction to actuate said retaining means to release said movable contact;

(f) a first helical spring, which is made predominantly of a shape memory effect material having an elastic modulus which varies significantly with temperature in a reversible manner over a transition temperature range, and which operatively acts on said armature mechanically to urge said armature in said direction on rise of temperature through said transition temperature range;

(g) said first helical spring cooperating with said armature electromagnetically to urge said armature in said direction on passage of an electric current through said spring;

(h) a second spring, which does not exhibit significant shape memory effect, and which operatively acts on said armature oppositely to said first spring; and (i) connection means for passing a current in series through said contacts when closed and said first spring.

9. An electrical overload circuit breaker as claimed in claim 8, wherein said retaining means is a toggle mechanism.

10. An electrical overload circuit breaker as claimed in claim 8, wherein said first spring acts in tension and said second spring acts in compression.

11. An electrical overload circuit breaker as claimed in claim 8, further comprising a magnetically permeable cage in which said armature is mounted; and wherein said first and second spring act between said cage and said armature.

12. An electrical overload circuit breaker as claimed in claim 11, further comprising adjustment means which is positionally adjustable in said cage and against which said second spring engages.

* * * * *